US009820035B2

(12) United States Patent
Dominijanni et al.

(10) Patent No.: US 9,820,035 B2
(45) Date of Patent: Nov. 14, 2017

(54) AUDIO SYSTEMS AND APPARATUS FOR VIBRATION ISOLATION

(71) Applicant: BOSE CORPORATION, Framingham, MA (US)

(72) Inventors: Andrew D. Dominijanni, Newtown, MA (US); Wit Cesary Bushko, Medway, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/081,413

(22) Filed: Mar. 25, 2016

(65) Prior Publication Data

US 2017/0280233 A1 Sep. 28, 2017

(51) Int. Cl.

| | |
|---|---|
| ***H04R 1/28*** | (2006.01) |
| ***H04R 7/18*** | (2006.01) |
| ***H04R 1/02*** | (2006.01) |
| ***H04R 9/06*** | (2006.01) |
| ***H04R 9/02*** | (2006.01) |

(52) U.S. Cl.

CPC ..... *H04R 1/2896* (2013.01); *H04R 1/025* (2013.01); *H04R 7/18* (2013.01); *H04R 9/025* (2013.01); *H04R 9/06* (2013.01); *H04R 2420/07* (2013.01)

(58) Field of Classification Search

CPC ..... H04R 1/025; H04R 1/28; H04R 1/2869–1/2896; H04R 7/16; H04R 7/18; H04R 7/20; H04R 7/26; H04R 9/025; H04R 9/045; H04R 9/06; H04R 2207/021; H04R 2209/027; H04R 2307/201; H04R 2307/204; H04R 2307/207; H04R 2400/07; H04R 2420/07

See application file for complete search history.

(56) References Cited

U.S. PATENT DOCUMENTS

| | | | | |
|---|---|---|---|---|
| 6,622,817 | B1 * | 9/2003 | Bachmann | H04R 1/403 181/150 |
| 8,103,033 | B2 | 1/2012 | Drake et al. | |
| 2004/0202338 | A1 * | 10/2004 | Longbotttom | H04R 17/00 381/190 |
| 2007/0246291 | A1 * | 10/2007 | Drake | H04R 5/02 181/141 |
| 2008/0279413 | A1 * | 11/2008 | Roemer | H04R 1/2896 381/392 |
| 2009/0245561 | A1 * | 10/2009 | Litovsky | H04R 1/2834 381/345 |
| 2013/0195311 | A1 * | 8/2013 | Sahyoun | H04R 1/2834 381/395 |
| 2014/0029782 | A1 * | 1/2014 | Rayner | H04R 1/2834 381/386 |
| 2016/0269820 | A1 * | 9/2016 | Rousseau | H04R 1/2873 |

* cited by examiner

*Primary Examiner* — Mark Fischer
(74) *Attorney, Agent, or Firm* — Lando & Anastasi, LLP

(57) ABSTRACT

Vibration isolated audio systems and apparatus are provided. In one example, an audio system may include a housing, an acoustic transducer positioned within an aperture of the housing, the acoustic transducer being configured to deliver acoustic energy based on a received audio signal, and at least one tuned vibration isolator positioned proximate the acoustic transducer and configured to substantially reduce vibration.

23 Claims, 7 Drawing Sheets

AUDIO SYSTEMS AND APPARATUS FOR VIBRATION ISOLATION

TECHNICAL FIELD

Aspects and implementations of the present disclosure are directed generally to audio systems, and in some examples, more specifically to vibration isolated transportable audio systems.

BACKGROUND

Traditionally, audio systems deliver audio content based on one or more audio signals received from a signal source. The audio signal is generally amplified and processed before being received at one or more speaker elements. In response to receiving the amplified and processed audio signal, the speaker elements radiate acoustic energy to deliver the corresponding audio content to nearby listeners. Transportable audio systems, which allow a user of the audio system to move the audio system, have become increasingly popular. Such transportable audio systems often include an input for connecting the transportable audio system to a portable source of audio content, such as a mobile device.

SUMMARY

In accordance with an aspect of the present disclosure, there is provided an audio system including one or more vibration isolated acoustic transducers. Specifically, the audio system includes one or more vibration isolators positioned proximate the acoustic transducer(s) of the audio system to substantially reduce vibration effects resulting from the delivery of acoustic energy. Particular vibration isolators of the audio system are tuned so as to reduce a magnitude of the vibrations effects for frequencies of the audio system. Such aspects and implementations are particularly advantageous in transportable audio systems where the audio system may be frequently positioned within the hands or a pocket of a user of the audio system.

According to one aspect, provided is an audio system. In one example, the audio system includes a housing, an acoustic transducer positioned within an aperture of the housing, the acoustic transducer being configured to deliver acoustic energy based on a received audio signal, and at least one tuned vibration isolator positioned proximate the acoustic transducer and configured to substantially reduce vibration.

In one example, the acoustic transducer includes a diaphragm, a motor structure coupled to the diaphragm and configured to displace the diaphragm to deliver acoustic energy, and a frame positioned to support at least the motor structure and the diaphragm. In an example, in being positioned proximate the acoustic transducer, the at least one tuned vibration isolator is interposed between the frame and the housing.

According to one example, the at least one tuned vibration isolator includes a single tuned vibration isolator disposed continuously along a perimeter of the frame. According to an example, the at least one tuned vibration isolator includes a plurality of tuned vibration isolators each disposed along a perimeter of the frame. In one example, in being positioned proximate the acoustic transducer, the at least one tuned vibration isolator is interposed between the motor structure and the frame so as to suspend the motor structure and the diaphragm relative to the frame.

According to an example, the tuned vibration isolator is defined by an isolator stiffness, and in substantially reducing the vibration, the tuned vibration isolator is further configured to reduce a magnitude of the vibration. In one example, the housing is configured to substantially seal the acoustic transducer within the housing to create an air stiffness within the housing, and the isolator stiffness is based at least in part on a mass of the diaphragm, a mass of the frame, and the air stiffness within the housing.

In one example, the isolator stiffness is defined according to:

$$k_i = m_b\left(\frac{k_{air}}{m_d}\right),$$

where, $k_i$ includes the isolator stiffness, $m_b$ includes the mass of the frame, $k_{air}$ includes the air stiffness, and $m_d$ includes the mass of the diaphragm. In an example, the tuned vibration isolator is an air suspension system.

According to one example, the isolator stiffness is defined according to:

$$k_i = m_m\left(\frac{k_{air} + k_s}{m_d}\right),$$

where, $k_i$ includes the isolator stiffness, $m_m$ includes a mass of the motor structure, $k_{air}$ includes an air stiffness within the housing, $k_s$ includes a stiffness of an acoustic transducer suspension, and $m_d$ includes a mass of the diaphragm.

In one example, the tuned vibration isolator is at least one of an elastomer material, a foam material, a cork material, a spring, and a dashpot. In an example, the housing is a transportable housing sized to fit in a clothing pocket.

According to another aspect, provided is an acoustic transducer. In one example, the acoustic transducer includes a diaphragm, a motor structure coupled to the diaphragm and configured to displace the diaphragm to deliver acoustic energy based on a received audio signal, a frame positioned to support at least the motor structure and the diaphragm, and at least one tuned vibration isolator coupled to the frame and configured to substantially reduce vibration.

In one example, the tuned vibration isolator is defined by an isolator stiffness, and in substantially reducing the vibration, the tuned vibration isolator is configured to reduce a magnitude of the vibration. In an example, the frame is sized to position the acoustic transducer within an aperture of a housing, and the isolator stiffness is based at least in part on a mass of the diaphragm, a mass of the frame, and an air stiffness within the housing. In one example, the isolator stiffness is defined according to:

$$k_i = m_b\left(\frac{k_{air}}{m_d}\right),$$

where, $k_i$ includes the isolator stiffness, $m_b$ includes the mass of the frame, $k_{air}$ includes the air stiffness, and $m_d$ includes the mass of the diaphragm.

In one example, the frame is sized to position the acoustic transducer within an aperture of a housing, and the isolator stiffness is defined according to:

$$k_i = m_m\left(\frac{k_{air} + k_s}{m_d}\right),$$

where, $k_i$ includes the isolator stiffness, $m_m$ includes a mass of the motor structure, $k_{air}$ includes an air stiffness within the housing, $k_s$ includes a stiffness of an acoustic transducer suspension, and $m_d$ includes a mass of the diaphragm.

In one example, the at least one tuned vibration isolator includes a single tuned vibration isolator disposed continuously along a perimeter of the frame. In an example, the at least one tuned vibration isolator is interposed between the motor structure and the frame so as to suspend the motor structure and the diaphragm relative to the frame. According to an example, the tuned vibration isolator is at least one of an elastomer material, a foam material, a cork material, a spring, a dashpot, and an air suspension system.

According to an aspect, provided is an audio system. In one example, the audio system includes an acoustic transducer configured to deliver acoustic energy, and a transportable housing, the delivery of acoustic energy causing a vibration of at least the transportable housing, the transportable housing including at least one aperture in a surface of the housing, the aperture sized to receive the acoustic transducer, and at least one tuned vibration isolator coupled between the transportable housing and the acoustic transducer to substantially reduce the vibration of the transportable housing.

In one example, the tuned vibration isolator is defined by an isolator stiffness, and in substantially reducing the vibration, the tuned vibration isolator is configured to reduce a magnitude of the vibration for a range of operable frequencies of the acoustic transducer. According to an example, the acoustic transducer includes a diaphragm, a motor structure coupled to the diaphragm and configured to displace the diaphragm to deliver acoustic energy, and a frame positioned to support at least the motor structure and the diaphragm.

According to an example, the isolator stiffness is defined according to:

$$k_i = m_b\left(\frac{k_{air}}{m_d}\right),$$

where, $k_i$ includes the isolator stiffness, $m_b$ includes a mass of the frame, $k_{air}$ includes an air stiffness within the transportable housing, and $m_d$ includes a mass of the diaphragm.

In one example, the isolator stiffness is defined according to:

$$k_i = m_m\left(\frac{k_{air} + k_s}{m_d}\right),$$

where, $k_i$ includes the isolator stiffness, $m_m$ includes a mass of the motor structure, $k_{air}$ includes an air stiffness within the transportable housing, $k_s$ includes a stiffness of an acoustic transducer suspension, and $m_d$ includes a mass of the diaphragm. In one example, the tuned vibration isolator is at least one of an elastomer material, a foam material, a cork material, a spring, a dashpot, and an air suspension system.

Still other aspects, examples, and advantages of these exemplary aspects and examples are discussed in detail below. Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example. Various aspects and examples described herein may include means for performing any of the described methods or functions.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the disclosure. In the figures, each identical or nearly identical component that is illustrated in various figures is represented by a like numeral. For purposes of clarity, not every component may be labeled in every figure. In the figures.

DETAILED DESCRIPTION

In accordance with an aspect of the present disclosure, there is provided an audio system including one or more vibration isolated acoustic transducers. Specifically, the audio system includes one or more vibration isolators positioned proximate the acoustic transducer(s) of the audio system to reduce vibration effects resulting from the delivery of acoustic energy. Particular vibration isolators of the audio system are tuned so as to reduce the magnitude of the vibrations for frequencies of the audio system. Such aspects and implementations are particularly advantageous in transportable audio systems where the audio system may be frequently positioned within the hands or a pocket of the user, and vibrations from the delivery of acoustic energy may be transmitted to the user. Such aspects and implementations may also eliminate vibration effects that cause movement or displacement of the audio system relative to a supporting surface. Accordingly, in at least one implementation provided is an improved vibration isolated transportable audio system.

It is to be appreciated that examples of the systems and apparatuses discussed herein are not limited in application to the details of construction and the arrangement of components set forth in the following description or illustrated in the accompanying drawings. The systems and apparatuses are capable of implementation in other examples and of being practiced or of being carried out in various ways.

Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and apparatuses or their components to any one positional or spatial orientation.

Figure 1:
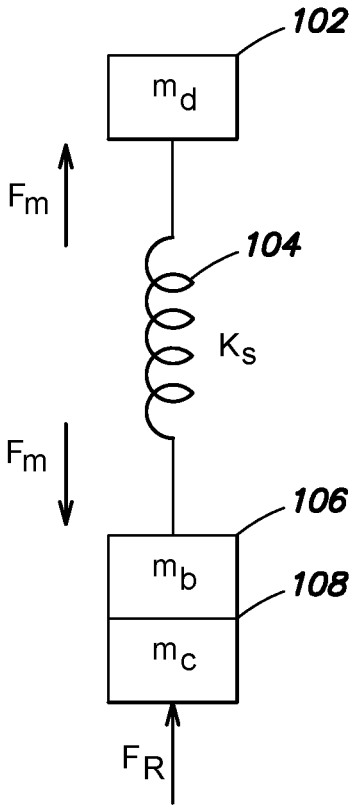
FIG. 1 (Related Art)
FIG. 1 is a force diagram of a traditional audio system.

Turning to FIG. 1, shown is an example force diagram for a traditional audio system. The example illustrates the undesirable vibration effects caused by movements of an acoustic transducer when delivering acoustic energy. These vibration effects may be transmitted to a user of the audio system, or a surface supporting the audio system. Traditional audio systems generally include an acoustic transducer (e.g., a loudspeaker) positioned within a speaker housing. The acoustic transducer has a diaphragm, a suspension, a motor structure (e.g., a magnet), and a basket. The diaphragm is shown in FIG. 1 as has having a mass, $m_d$ (block 102), the motor structure and basket are shown as having a combined mass, $m_b$ (block 106), and the housing is shown as having a mass, $m_c$ (block 108). The suspension (spring 104) of the traditional audio system is shown having a stiffness represented by $k_s$.

Loudspeakers, such as the acoustic transducer illustrated in FIG. 1, act as a mechanical oscillator when audio signals are received from a source at the motor structure. That is, the motor structure drives the diaphragm with a motor force, $F_m$, to deliver corresponding acoustic energy based on the received signal. Specifically, the motor force drives the diaphragm (typically through a voice coil) to create waves of acoustic energy and achieve the desired acoustic radiation pattern. However, the motor force also acts equally and oppositely on the motor structure and basket, which are typically rigidly mounted to the housing of the audio system. When the audio system is held by a user, or placed on a supporting surface (e.g., a table), this reaction force ($F_R$) is transmitted to the user or surface. Vibrations of the housing caused by the motor force can be a significant inconvenience for the user, and in some instances, can cause discomfort when the audio system is being held. Further, vibrations of the housing may also compromise the quality of the audio content delivered by the audio system. For instance, if the audio system is not properly balanced, or placed on an unstable supporting surface, vibrations of the housing can cause the generation of unintended noise such as rattling, buzzing, or other sounds from movement of the audio system relative to the supporting surface.

Accordingly, various aspects and implementations discussed herein include one or more tuned vibration isolators positioned proximate an acoustic transducer of an audio system and configured to substantially reduce vibrations caused by the delivery of acoustic energy. Specifically, various aspects and implementations substantially reduce the reaction force that would be otherwise transmitted to a user and/or a supporting surface of the audio system during delivery of acoustic energy. Furthermore, various aspects and examples allow isolation of vibrations for an entire range of frequencies of the audio system, which in some instances includes at least an operable frequency range of the associated acoustic transducer (e.g., low frequencies, mid-range frequencies, and/or high-range frequencies). As discussed in further detail below, tuned vibration isolators may be integral to an acoustic transducer of the improved audio system, or integral to a housing of the improved audio system. Such aspects and implementations allow components of the improved audio system to be produced independently to reduce production costs and expenses.

Figure 2:
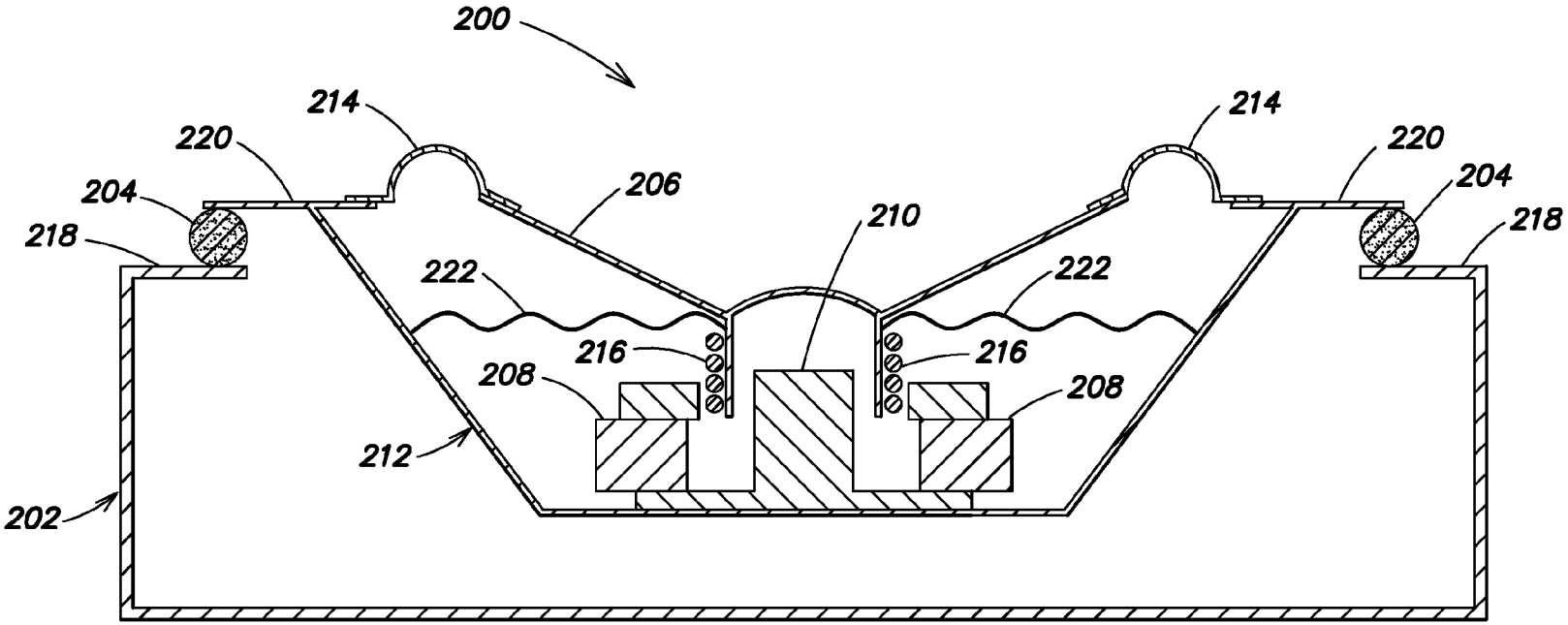
FIG. 2 is a cross-sectional view of an example audio system according to at least one implementation.

FIG. 2 shows a cross-sectional view of one example of an audio system 200 according to various aspects of the disclosure. While in one instance the audio system 200 may include a transportable audio system, in other examples the audio system 200 may include other consumer audio systems. In the shown example, the audio system 200 includes a housing 202, at least one acoustic transducer, and one or more tuned vibration isolator 204. The housing 202 may include a transportable housing, such as a housing sized to fit in a clothing pocket, and may define at least one aperture in which the acoustic transducer may be positioned. The acoustic transducer may include a diaphragm 206, a motor structure (e.g., a magnet 208 and a magnet structure 210), a frame 212, and a suspension (e.g., a surround 214 and a spider 222). While not explicitly shown in FIG. 2, in various implementations, the audio system 200 may further include acoustic waveguide structures, passive radiators, acoustic insulators, dampening material, and/or additional components that improve the performance of the audio system 200.

The audio system 200 provides audio content to a listener via corresponding acoustic energy delivered by the acoustic transducer. While shown including a single acoustic transducer for the convenience of illustration, in certain examples the audio system 200 may include multiple acoustic transducers each of which operates in a manner similar to the described acoustic transducer. The audio system 200 is coupled to a source of audio signals and configured to receive an audio signal which specifies the audio content to be delivered. For instance, the audio signal source may include a cell phone, an MP3 player, a CD player, a personal computer, a tablet, or any other mobile device. The audio signal source may be included within the audio system 200 (e.g., within the housing 202), or may be external and communicate via an interface with the audio system 200. For instance, the audio system 200 may include a wireless component configured to receive an audio signal via a wireless protocol. For example, audio system 200 can include a wireless component having hardware or software configured to receive the audio signal via a wireless protocol such as BLUETOOTH®, Bluetooth Low Energy (BLE), WiFi, Zigbee, or Propriety Radio. As used herein, BLUETOOTH® refers to a short range ad hoc network, otherwise known as piconets. In further examples, the wireless component may include hardware or software to support both BLUETOOTH® and Bluetooth Low Energy. In other examples, the audio system 200 may include an input for receiving a mechanical connection with the audio signal source, such as an input for receiving a cabled connection. In various examples, the audio system may 200 also include an audio signal processor, such as a digital signal processor. The audio signal processor may perform audio signal processing according to various known audio signal processing algorithms.

Responsive to receiving the audio signal, the acoustic transducer delivers acoustic energy to provide a user and/or listeners with corresponding audio content. In various examples, the acoustic transducer may include a directional loudspeaker including a cone-type acoustic driver. However, in various other implementations the acoustic transducer may include a directional loudspeaker of a type other than a cone-type, such as dome-type, or a flat-panel type. In the shown example, the acoustic transducer includes the diaphragm 206, the motor structure, the suspension, and the frame 212. While in other implementations the components of the acoustic transducer may be positioned in other arrangements, in the example of FIG. 2, the frame 212 is mechanically coupled to and supports the diaphragm 206 and the motor structure. Specifically, the motor structure is mounted to a base of the frame 212, and the diaphragm 206 is suspended across an opening in the frame 206 by the suspension (e.g., the surround 214 and the spider 222). While shown as including a dual-plane suspension including the surround 214 and the spider 222, in various examples the suspension may include a single-plane suspension (e.g., the surround 214 alone). In various implementations, the frame 212 is sized so as to fit within the aperture of the housing 202.

As FIG. 2 shows, the motor structure may include a magnet 208, a magnet structure 210, and a voice coil 216. In particular, FIG. 2 shows the magnet structure 210 including a back plate, a pole piece, and a top plate, although other types of magnet structures 210 and motor structures may be used. The magnet 208 and magnet structure 210 are coupled together and mounted to the frame 212, and the diaphragm 206 is coupled to the voice coil 216 and a voice coil former. In the example, receiving the audio signal at the voice coil 216 alternates the magnetic force between the voice coil 216 and the magnet 208, generating a motor force to translate the diaphragm 206. In various implementations, the diaphragm 206 moves in a linear direction to create acoustic energy waves and provide audio content to a user, and/or listeners. While not shown in the example of FIG. 2, the acoustic transducer may include additional protective components such as a dust cover and/or a dust screen. As discussed above, often the delivery of acoustic energy will cause a substantially equal and opposite reaction force on the housing 202, which may cause vibration effects within the audio system 200. In particular, vibration effects may arise when a peak magnitude of the motor force of the motor structure exceeds a mass of the audio system 200.

Accordingly, in various implementations, the audio system 200 includes one or more tuned vibration isolator 204 positioned proximate the acoustic transducer and configured to substantially reduce the vibration effects. In at least one example, the one or more tuned vibration isolator 204 is interposed between the acoustic transducer and the housing 202, for example, between the frame 212 and the housing 202. FIG. 1 shows the one or more tuned vibration isolator 204 interposed between an overlapping exterior surface 218 of the housing 202 and an arm 220 of the frame 212. As shown, the one or more tuned vibration isolator 204 suspends the acoustic transducer relative to the housing 202. That is, the one or more tuned vibration isolator 204 supports the weight of the acoustic transducer and positions the acoustic transducer as a counter-mass to motor force. Accordingly, the one or more tuned vibration isolator 204 provides a second degree of freedom to mechanically reduce the unwanted vibrations within the audio system 200. Specifically, the one or more tuned vibration isolator 204 passively isolates the housing 202 of the audio system 200 from movements of the acoustic transducer.

Figure 3A:
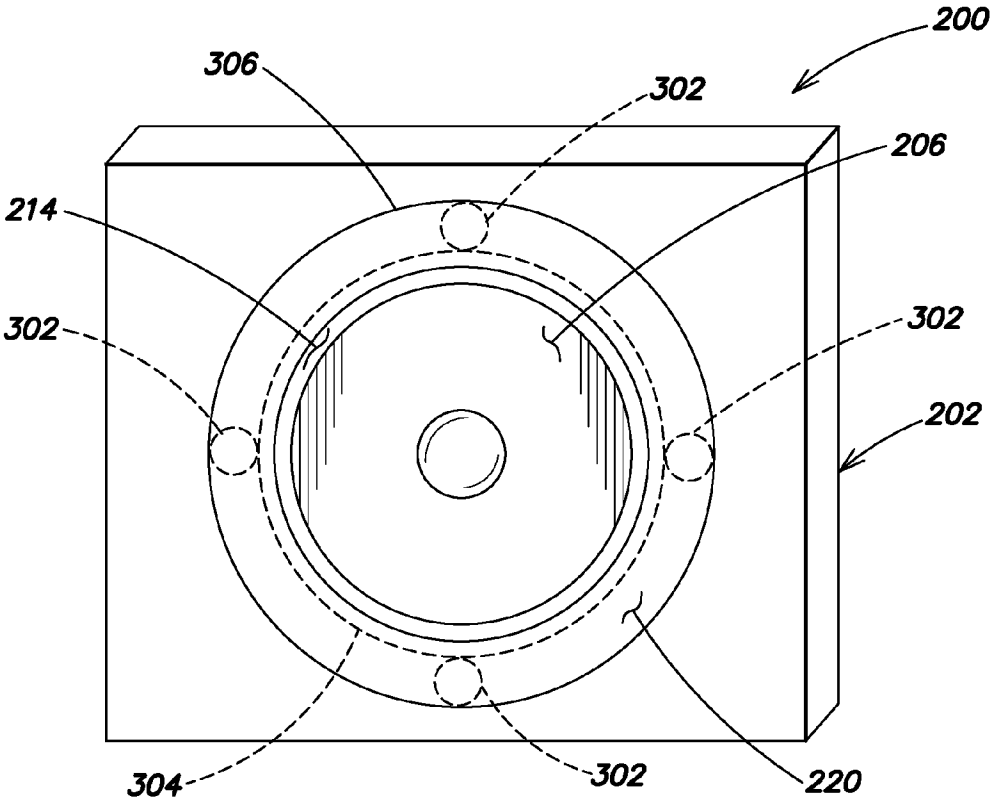
FIG. 3A is a top view of the example audio system of FIG. 2, according to at least one implementation.
Figure 3B:
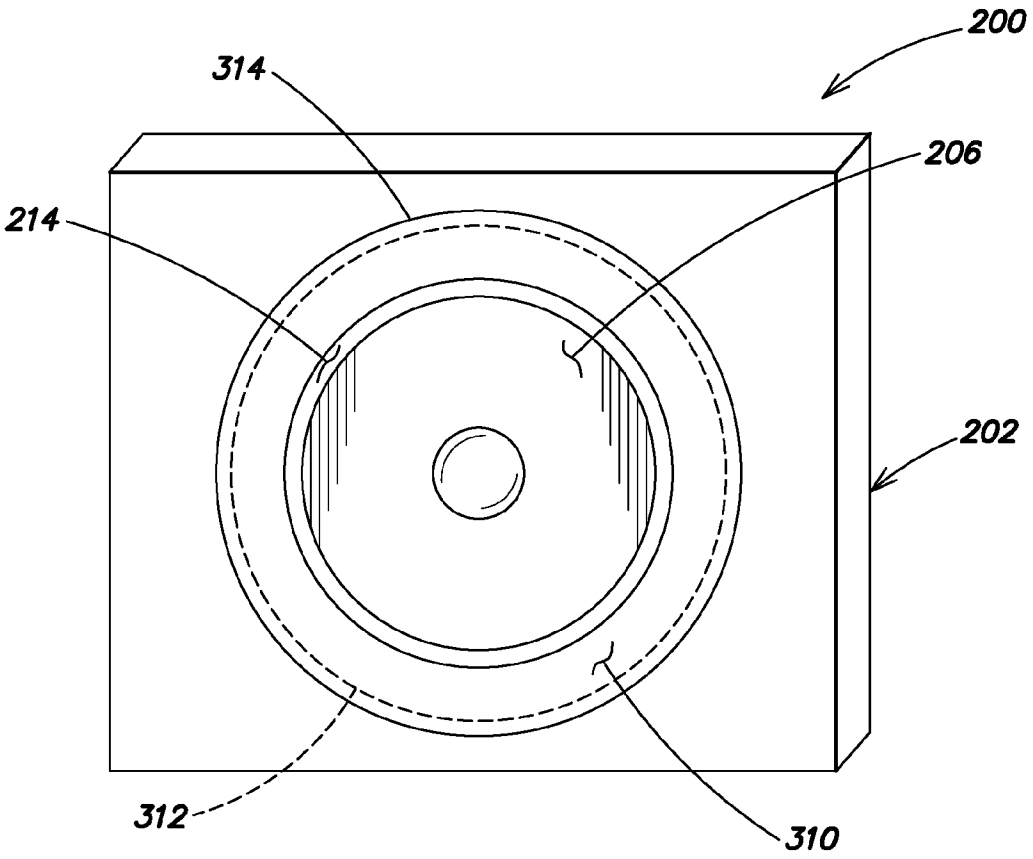
FIG. 3B is a top view of another variation of the example audio system of FIG. 2, according to at least one implementation.

Turning to FIGS. 3A-3B, in various implementations the one or more tuned vibration isolator 204 may include a single tuned vibration isolator disposed continuously along a perimeter of the frame 212. In various other implementations, the one or more tuned vibration isolator 204 may include a plurality of tuned vibration isolators each disposed discretely along the perimeter of the frame 212. FIG. 3A shows one example of the acoustic transducer having a plurality of tuned vibration isolators 302 each disposed discretely along the perimeter of the frame 212, and FIG. 3B shows one example of the acoustic transducer having a single tuned vibration isolator 310 disposed continuously along a perimeter of the frame 212.

Referring to FIG. 3A, shown is a top view of the example audio system 200 of FIG. 2. The one or more vibration isolator 204 may include a plurality of tuned vibration isolators 302, each interposed between the overlapping exterior surface 218 of the housing 202 and the arm 220 of the frame 212. As shown, in such an example the tuned vibration isolators 302 suspend the acoustic transducer relative to the housing 202. That is, the tuned vibration isolators 302 support the weight of the acoustic transducer. In FIG. 3A, the aperture of the housing 202 is illustrated as ghost line 304, with the overlapping area of the exterior surface 218 of the housing 202 and the arm 220 of the frame 212 being the area between the ghost line 304 and the extremes of the arm 220 of the frame 212 (e.g., extreme line 306).

Referring now to FIG. 3B, in another variation, the tuned vibration isolator 204 may be disposed along the perimeter of the frame 212 and concentric with the frame 212. FIG. 3B shows another variation of the audio system 200 in which the tuned vibration isolator 204 includes a single continuous tuned vibration isolator 310. For instance, FIG. 3B shows the tuned vibration isolator 310 shaped as an isolator ring extending outwardly from the frame 212 of the acoustic transducer. In such an example, the tuned vibration isolator 310 may be positioned to overlap with the exterior surface 218 of the housing 202 and suspend the acoustic transducer within the aperture of the housing 202. In FIG. 3B, the aperture of the housing is illustrated as ghost line 312, with the overlapping area of the frame 212 and the tuned vibration isolator 310 being the area between the ghost line 312 and the extremes of the tuned vibration isolator 310 (e.g., extreme line 314).

Returning to FIG. 2, in various implementations the one or more tuned vibration isolator 204 is configured to reduce a magnitude of the vibration for frequencies of the audio system 200, including at least a range of operable frequencies of the acoustic transducer. In one particular implementation, the magnitude of the vibration may be reduced to substantially eliminate the vibration (e.g., reduce the magnitude to about zero). That is, in various examples the tuned vibration isolator 204 offers the benefit of reduced vibrations corresponding to an entire frequency range of delivered acoustic energy. The one or more vibration isolator 204 of various implementations is configured to reduce vibrations within a low frequency range, a mid-frequency range, and/or a high frequency range of the delivered acoustic energy. For instance, a low frequency range may include a range of audible frequencies below 200 Hz, the mid-frequency range may include a range of frequencies between 200 Hz and 2 kHz, and the high frequency range may include a range of audible frequencies above 2 kHz. In various implementations, a stiffness of the tuned vibration isolator 204 may be based at least in part on a mass of the diaphragm 206, a mass of the frame 212, and an air stiffness within the housing 202.

Figure 4:
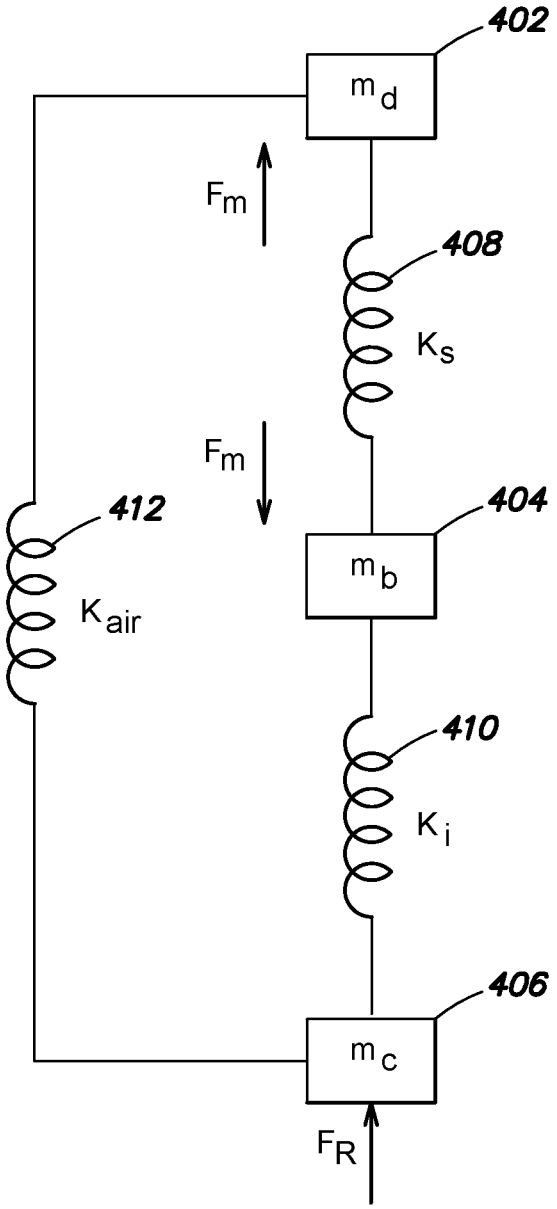
FIG. 4 is an example force diagram of the example audio system of FIG. 2, according to at least one implementation.

Turning now to FIG. 4, shown is an example force diagram of the example audio system 200 of FIG. 2. The shown example illustrates the reduced undesirable vibrations effects caused by movements of the acoustic transducer when delivering acoustic energy. In the example force diagram, the diaphragm 206 is shown has having a mass, $m_d$ (block 402), the motor structure and frame 212 are shown having a combined mass, $m_b$ (block 404), and the housing 202 is shown as having a mass, $m_c$ (block 406). The suspension of the acoustic transducer is shown having a suspension stiffness represented by $k_s$ (spring 408), the one or more tuned vibration isolator 204 is shown having an isolator stiffness represented by $k_i$ (spring 410), and an air stiffness within the housing 202 is represented by air stiffness $k_{air}$ (spring 412). In various implementations, the housing 202 is configured to create a seal about the acoustic transducer creating an air stiffness within the housing 202. While in one variation, the one or more tuned vibration isolator 204 may act as the seal, in various other implementations other sealing structures may be used.

As discussed above, the motor structure drives the diaphragm 206 with a motor force, $F_m$, to deliver corresponding acoustic energy to a listener. The motor force also acts equally and oppositely on the motor structure and the frame 212, creating reaction force, $F_R$, when the motor force exceeds the mass of the system 200. However, in contrast to non-isolated systems, which may then impart the reaction force, $F_R$, on a user and/or a supporting surface, the tuned vibration isolator 204 of the audio system 200 reduces the reaction force to about zero. The one or more tuned vibration isolator 204 substantially isolate the housing 202 from vibrations. Specifically, the addition of a second mechanical degree of freedom (i.e., the one or more tuned vibration isolator 204), compared to conventional audio systems, allows the generation of a model for which the reaction force is about zero, regardless of the motor force and acceleration of the diaphragm 206.

In particular, a transfer function between the motor force and the reaction force, and a transfer function between the diaphragm 206 acceleration and the reaction force, may be used to generate a model for defining characteristics of components of the audio system 200, such as the isolator stiffness, $k_i$. In various implementations, characteristics of components of the audio system 200 may be defined based at least in part on:

$$\frac{k_{air}}{m_d} = \frac{k_i}{m_b}.$$

Satisfaction of the foregoing model ensures that the one or more tuned vibration isolator 204 substantially reduces any undesired vibrations of the audio system 200, regardless of the frequency (e.g., for an entire frequency range of the audio system 200). Accordingly, in one implementation the isolator stiffness may be chosen according to:

$$k_i = m_b\left(\frac{k_{air}}{m_d}\right).$$

Similarly, the combined mass of the motor structure and frame 212 may be chosen according to:

$$m_b = \left(\frac{m_d k_i}{k_{air}}\right).$$

In various other implementations, the above model may be adjusted if an effective area of the frame 212 ($S_b$) is significantly larger than an effective area of the diaphragm 206 ($S_d$). Such a corrected model may include:

$$k_i = k_{air}\eta\left(\frac{m_b}{m_d} - (\eta - 1)\right), \text{ where}$$

$$\eta = \frac{s_b}{s_d} \geq 1.$$

It is appreciated that in practice, at a given frequency, the isolator stiffness ($k_i$) of the one or more tuned vibration isolator 204, and the air stiffness ($k_{air}$) within the housing 202, may have both a real part and an imaginary part when modeled. Accordingly, in various implementations both the real and imaginary parts of the isolator stiffness and the air stiffness may be balanced. That is, in some implementations the isolator stiffness may be chosen such that both the real part and the imaginary part of the isolator stiffness satisfy the model discussed above, $$\frac{k_{air}}{m_d} = \frac{k_i}{m_b}.$$

In various examples, the one or more tuned vibration isolator 204 is composed of at least one of an elastomer material, a foam material, a cork material, a spring, and a dashpot. For example, the one or more tuned vibration isolator 204 may be a silicone material or a polyurethane material. However, in various other implementations, the tuned vibration isolator 204 may include an air suspension system. In such an implementation, the isolator stiffness of the air suspension system may be substantially the same as the air stiffness within the housing 202. At least this implementation has the benefit that it makes the one or more tuned vibration isolator 204 insensitive to temperature, altitude, and other ambient condition changes. Because the isolator stiffness will vary in substantially the same manner as the air stiffness within the housing 202, the model discussed above remains primarily a relationship of masses, which only vary minimally during temperature, altitude, and other ambient condition changes. In particular implementations, one or more channels between the one or more tuned vibration isolator 204 and the sealed interior of the housing 202 may ensure an equilibrium air stiffness.

Figure 5:
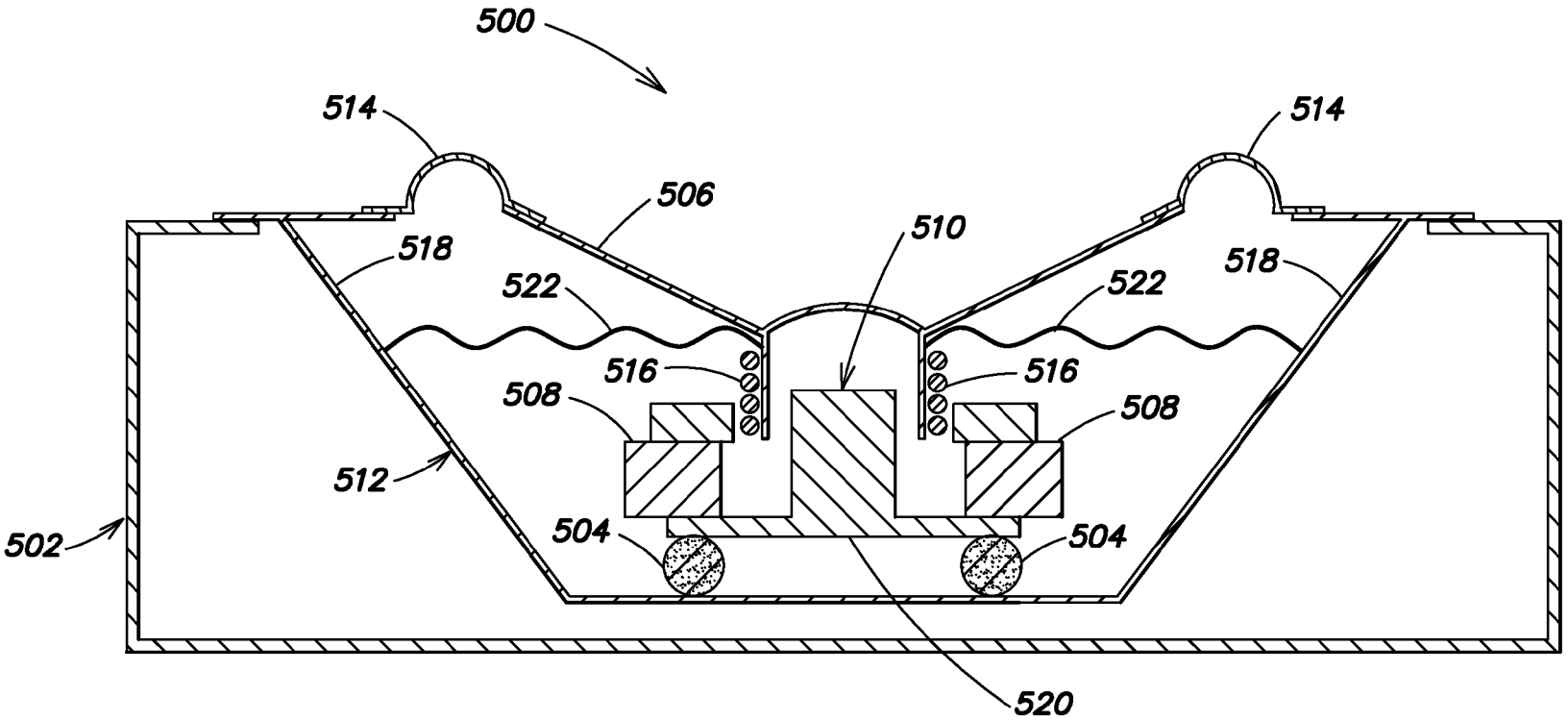
FIG. 5 is a cross-sectional view of an example audio system according to at least one implementation.

Turning now to FIG. 5, FIG. 5 shows another variation of an example audio system 500 according to various aspects and implementations. The example audio system 500 of FIG. 5 may include many of the same components as the example audio system 200 illustrated in FIG. 2, such as a housing 502, at least one acoustic transducer, and one or more vibration isolator 504. The audio system 500 may also operate in a similar manner to deliver audio content to a user or listeners. While in one instance the audio system 500 may include a transportable audio system, in other examples the audio system 500 may include other consumer audio systems. The acoustic transducer may include a diaphragm 506, a motor structure (e.g., a magnet 508 and a magnet structure 510), a frame 512, and a suspension (e.g., a surround 514 and a spider 522). While shown as including a dual-plane suspension including the surround 514 and the spider 522, in various examples the suspension may include a single-plane suspension (e.g., the surround 514 alone). Further, while FIG. 5 shows the magnet structure 510 including a back plate, a pole piece, and a top plate, other types of magnet structures 510 and motor structures may be used. In various implementations, the audio system 500 may also include acoustic waveguide structures, passive radiators, acoustic insulators, dampening material, and/or additional components that improve the performance of the audio system 500.

While various aspects and implementations discussed herein may include an audio system having one or more tuned vibration isolator interposed between an acoustic transducer and a housing of the system (e.g., the example audio system 200), in other variations, aspects and implementations may include an audio system having one or more tuned vibration isolator positioned within an acoustic transducer to reduce undesirable vibration effects. For instance, FIG. 5 shows the audio system 500 including a plurality of tuned vibration isolators 504 interposed between the motor structure (e.g., the magnet structure 510) of the acoustic transducer and the frame 512. Tuned vibration isolators 504 positioned in such a manner may suspend the motor structure and the diaphragm 506 relative to the frame 512 of the acoustic transducer. In various examples, the weight of the motor structure acts as a counter-mass to the motor force of the motor structure. In such implementations, the frame 512 of the acoustic transducer may be rigidly mounted to the housing 502.

In the example audio system 500 of FIG. 5, each of the plurality of tuned vibration isolators 504 may be interposed between the frame 512 and the magnet structure 510 of the motor structure. FIG. 5 shows the tuned vibration isolators 504 interposed between a base surface (e.g., base plate) 520 of the motor structure and an interior surface 518 of the frame 512. Each tuned vibration isolator 504 may be positioned to create an air space between the base surface 520 of the magnet structure 510 and the frame 512. While shown in FIG. 5 as discrete tuned vibration isolators for the convenience of illustration, in various implementations each tuned vibration isolator 504 may be disposed continuously along the base surface 520 of the magnet structure 510. Similar to the one or more tuned vibration isolator 204 discussed above with reference to FIG. 2, in various implementations the tuned vibration isolators 504 may include at least one of an elastomer material, a foam material, a cork material, a spring, and a dashpot. In other implementations, the tuned vibration isolators 504 may include an air suspension system.

In various implementations, the tuned vibration isolators 504 are configured to reduce a magnitude of vibrations resulting from the delivery of acoustic energy for frequencies of the audio system. In certain examples, the frequencies of the audio system 500 may include at least a range of operable frequencies of the acoustic transducer. In one particular implementation, the magnitude of the vibration may be reduced to substantially eliminate the vibration (e.g., reduce the magnitude to about zero). That is, in various examples the tuned vibration isolator 204 offers the benefit of reduced vibrations corresponding to an entire frequency range of delivered acoustic energy. In various examples, tuned vibration isolators 504 are configured to reduce vibrations within a low frequency range, a mid-frequency range, and a high frequency range of the delivered acoustic energy, as discussed above. In various implementations, a stiffness of the tuned vibration isolators 504 may be based at least in part on a mass of the diaphragm 506, a mass of the motor structure, a stiffness of the suspension, and an air stiffness within the housing 512.

Figure 6:
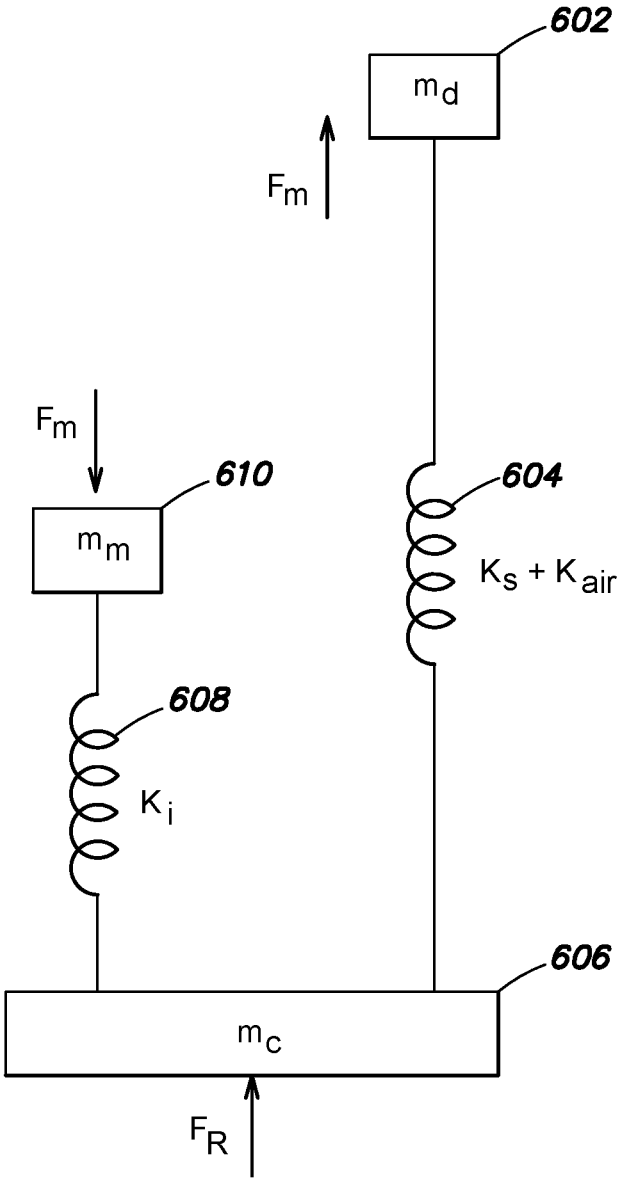
FIG. 6 is an example force diagram of the example audio system of FIG. 5, according to at least one implementation.

FIG. 6 shows an example force diagram of the example audio system 500 of FIG. 5. The shown example illustrates the reduction in vibration effects caused by movements of the acoustic transducer when delivering acoustic energy. In the example force diagram, the diaphragm 506 is shown has having a mass, $m_d$ (block 602), the motor structure is shown as having a mass, $m_m$ (block 610), and the housing 502 is shown as having a mass, $m_c$ (block 606). The suspension of the acoustic transducer is shown having a suspension stiffness represented by $k_s$ (block 604), the tuned vibration isolators 504 is shown having an isolator stiffness represented by $k_i$ (spring 608), and an air stiffness within the housing 502 is represented by air stiffness $k_{air}$ (spring 604). In various implementations, the housing 502 is configured to create a seal about the acoustic transducer creating an air stiffness within the housing 502.

As discussed above with reference to the example audio system 500 of FIG. 5, the motor structure may drive the diaphragm 506 with a motor force, $F_m$, to deliver corresponding acoustic energy. The motor force also acts equally and oppositely on the motor structure, creating reaction force, $F_R$, when the motor force exceeds the mass of the system 500. However, in contrast to non-isolated systems, which may then impart the reaction force on a user and/or a supporting surface, the tuned vibration isolators 504 of the audio system 500 reduce the reaction force to about zero. Specifically, the addition of a second mechanical degree of freedom compared to conventional audio systems allows the generation of a model for which the reaction force is about zero, regardless of the motor force and acceleration of the diaphragm 506. In particular, a transfer function between the motor force and the reaction force, and a transfer function between the diaphragm 506 acceleration and the reaction force, may be used to generate a model for defining characteristics of components of the audio system 500, such as the isolator stiffness, $k_i$. In various implementations, characteristics of components of the audio system 500 may be defined based at least in part on:

$$\frac{k_{air}+k_s}{m_d}=\frac{k_i}{m_m}.$$

Satisfaction of the foregoing model ensures that tuned vibration isolators 504 substantially reduce the magnitude of any undesired vibrations. Accordingly, in one implementation the isolator stiffness may be chosen according to:

$$k_i=m_m\left(\frac{k_{air}+k_s}{m_d}\right).$$

Similarly, the mass of the motor structure may be chosen according to:

$$m_m=\left(\frac{m_d k_i}{k_{air}+k_s}\right).$$

Accordingly, various aspects and implementations provide an audio system including one or more vibration isolated acoustic transducers. Specifically, the audio system includes one or more vibration isolators positioned proximate the acoustic transducer(s) of the audio system to reduce vibration effects resulting from the delivery of acoustic energy. Particular vibration isolators of the audio system are tuned so as to reduce the magnitude of the vibrations effects to effectively eliminate the vibration effects. Such aspects and implementations are particularly advantageous in transportable audio systems where the audio system may be frequently positioned within the hands or a pocket of the user of the audio system, and vibrations from the delivery of acoustic energy may be transduced to a housing of the audio system. Accordingly, in at least one implementation provided is an improved vibration isolated transportable audio system.

Having described above several aspects of at least one implementation, it is to be appreciated various alterations, modifications, and improvements will readily occur to those skilled in the art. Such alterations, modifications, and improvements are intended to be part of this disclosure and are intended to be within the scope of the description. Accordingly, the foregoing description and drawings are by way of example only, and the scope of the disclosure should be determined from proper construction of the appended claims, and their equivalents.

What is claimed is:

1. An audio system comprising:

a housing;

an acoustic transducer positioned within an aperture of the housing, the acoustic transducer being configured to deliver acoustic energy based on a received audio signal, wherein the housing is configured to substantially seal the acoustic transducer within the housing to create an air stiffness within the housing, the acoustic transducer including:

a diaphragm, a motor structure coupled to the diaphragm and configured to displace the diaphragm to deliver acoustic energy, and a frame positioned to support at least the motor structure and the diaphragm; and at least one tuned vibration isolator positioned proximate the acoustic transducer and configured to substantially reduce a magnitude of a vibration, the tuned vibration isolator being defined by an isolator stiffness, wherein the isolator stiffness is based at least in part on a mass of the diaphragm, a mass of the frame, and the air stiffness within the housing.

2. The audio system according to claim 1, wherein in being positioned proximate the acoustic transducer, the at least one tuned vibration isolator is interposed between the frame and the housing.

3. The audio system according to claim 2, wherein the at least one tuned vibration isolator includes a single tuned vibration isolator disposed continuously along a perimeter of the frame.

4. The audio system according to claim 2, wherein the at least one tuned vibration isolator includes a plurality of tuned vibration isolators each disposed along a perimeter of the frame.

5. The audio system according to claim 1, wherein the isolator stiffness is defined according to:

$$k_i = m_b\left(\frac{k_{air}}{m_d}\right),$$

wherein, $k_i$ includes the isolator stiffness, $m_b$ includes the mass of the frame, $k_{air}$ includes the air stiffness, and $m_d$ includes the mass of the diaphragm.

6. The audio system according to claim 1, wherein the tuned vibration isolator is an air suspension system.

7. The audio system according to claim 1, wherein the tuned vibration isolator is at least one of an elastomer material, a foam material, a cork material, a spring, and a dashpot.

8. The audio system according to claim 1, wherein the housing is a transportable housing sized to fit in a clothing pocket.

9. An audio system comprising:

a housing;

an acoustic transducer positioned within an aperture of the housing, the acoustic transducer being configured to deliver acoustic energy based on a received audio signal, the acoustic transducer including:

a diaphragm, a motor structure coupled to the diaphragm and configured to displace the diaphragm to deliver acoustic energy, and a frame positioned to support at least the motor structure and the diaphragm; and at least one tuned vibration isolator positioned proximate the acoustic transducer and configured to substantially reduce a magnitude of a vibration, wherein the tuned vibration isolator is defined by an isolator stiffness, and wherein the isolator stiffness is defined according to:

$$k_i = m_m\left(\frac{k_{air} + k_s}{m_d}\right),$$

wherein, $k_i$ includes the isolator stiffness, $m_m$ includes a mass of the motor structure, $k_{air}$ includes an air stiffness within the housing, $k_s$ includes a stiffness of an acoustic transducer suspension, and $m_d$ includes a mass of the diaphragm.

10. The audio system according to claim 9, wherein in being positioned proximate the acoustic transducer, the at least one tuned vibration isolator is interposed between the motor structure and the frame so as to suspend the motor structure and the diaphragm relative to the frame.

11. The audio system according to claim 9, wherein the tuned vibration isolator is at least one of an elastomer material, a foam material, a cork material, a spring, and a dashpot.

12. The audio system according to claim 9, wherein the housing is a transportable housing sized to fit in a clothing pocket.

13. An acoustic transducer comprising:

a diaphragm;

a motor structure coupled to the diaphragm and configured to displace the diaphragm to deliver acoustic energy based on a received audio signal;

a frame positioned to support at least the motor structure and the diaphragm, wherein the frame is sized to position the acoustic transducer within an aperture of a housing; and at least one tuned vibration isolator coupled to the frame and configured to substantially reduce a magnitude of a vibration, wherein the tuned vibration isolator defined by an isolator stiffness, and wherein the isolator stiffness is based at least in part on a mass of the diaphragm, a mass of the frame, and an air stiffness within the housing.

14. The acoustic transducer according to claim 13, wherein the isolator stiffness is defined according to:

$$k_i = m_b\left(\frac{k_{air}}{m_d}\right),$$

wherein, $k_i$ includes the isolator stiffness, $m_b$ includes the mass of the frame, $k_{air}$ includes the air stiffness, and $m_d$ includes the mass of the diaphragm.

15. The acoustic transducer according to claim 13, wherein the at least one tuned vibration isolator includes a single tuned vibration isolator disposed continuously along a perimeter of the frame.

16. The acoustic transducer according to claim 13, wherein the tuned vibration isolator is at least one of an elastomer material, a foam material, a cork material, a spring, a dashpot, and an air suspension system.

17. An acoustic transducer comprising:

a diaphragm;

a motor structure coupled to the diaphragm and configured to displace the diaphragm to deliver acoustic energy based on a received audio signal;

a frame positioned to support at least the motor structure and the diaphragm; and at least one tuned vibration isolator coupled to the frame and configured to substantially reduce a magnitude of a vibration, the tuned vibration isolator being defined by an isolator stiffness, wherein the frame is sized to position the acoustic transducer within an aperture of a housing, and wherein the isolator stiffness is defined according to:

$$k_i = m_m\left(\frac{k_{air} + k_s}{m_d}\right),$$

wherein, $k_i$ includes the isolator stiffness, $m_m$ includes a mass of the motor structure, $k_{air}$ includes an air stiffness within the housing, $k_s$ includes a stiffness of an acoustic transducer suspension, and $m_d$ includes a mass of the diaphragm.

18. The acoustic transducer according to claim 17, wherein the at least one tuned vibration isolator is interposed between the motor structure and the frame so as to suspend the motor structure and the diaphragm relative to the frame.

19. The acoustic transducer according to claim 17, wherein the tuned vibration isolator is at least one of an elastomer material, a foam material, a cork material, a spring, a dashpot, and an air suspension system.

20. An audio system comprising:

an acoustic transducer configured to deliver acoustic energy, the acoustic transducer including:

a diaphragm, a motor structure coupled to the diaphragm and configured to displace the diaphragm to deliver acoustic energy, and a frame positioned to support at least the motor structure and the diaphragm; and a transportable housing, the delivery of acoustic energy causing a vibration of at least the transportable housing, the transportable housing including:

at least one aperture in a surface of the housing, the aperture sized to receive the acoustic transducer; and at least one tuned vibration isolator coupled between the transportable housing and the acoustic transducer and configured to substantially reduce a magnitude of the vibration of the transportable housing for a range of operable frequencies of the acoustic transducer, wherein the vibration isolator is defined by an isolator stiffness and the isolator stiffness is defined according to:

$$k_i = m_b\left(\frac{k_{air}}{m_d}\right),$$

wherein $k_i$ includes the isolator stiffness, $m_b$ includes a mass of the frame, $k_{air}$ includes an air stiffness within the transportable housing, and $m_d$ includes a mass of the diaphragm.

21. The audio system according to claim 20, wherein the tuned vibration isolator is at least one of an elastomer material, a foam material, a cork material, a spring, a dashpot, and an air suspension system.

22. An audio system comprising:

an acoustic transducer configured to deliver acoustic energy, the acoustic transducer including:

a diaphragm, a motor structure coupled to the diaphragm and configured to displace the diaphragm to deliver acoustic energy, and a frame positioned to support at least the motor structure and the diaphragm; and a transportable housing, the delivery of acoustic energy causing a vibration of at least the transportable housing, the transportable housing including:

at least one aperture in a surface of the housing, the aperture sized to receive the acoustic transducer; and at least one tuned vibration isolator coupled between the transportable housing and the acoustic transducer and configured to substantially reduce a magnitude of the vibration of the transportable housing for a range of operable frequencies of the acoustic transducer, wherein the tuned vibration isolator is defined by an isolator stiffness and the isolator stiffness is defined according to:

$$k_i = m_m\left(\frac{k_{air} + k_s}{m_d}\right),$$

wherein, $k_i$ includes the isolator stiffness, $m_m$ includes a mass of the motor structure, $k_{air}$ includes an air stiffness within the transportable housing, $k_s$ includes a stiffness of an acoustic transducer suspension, and $m_d$ includes a mass of the diaphragm.

23. The audio system according to claim 22, wherein the tuned vibration isolator is at least one of an elastomer material, a foam material, a cork material, a spring, a dashpot, and an air suspension system.

* * * * *